US005654132A

United States Patent [19]

Lau et al.

[11] Patent Number: 5,654,132

[45] Date of Patent: Aug. 5, 1997

[54] PHOTOGRAPHIC MATERIALS AND PROCESS COMPRISING UREIDO NAPHTHOLIC CYAN COUPLERS

[75] Inventors: Philip T.S. Lau; Stanley Wray Cowan, both of Rochester, N.Y.

[73] Assignee: Eastman Kodak Company, Rochester, N.Y.

[21] Appl. No.: 644,390

[22] Filed: May 10, 1996

Related U.S. Application Data

[60] Provisional application No. 60/006,048 Oct. 24, 1995.

[51] Int. Cl.[6] ..... G03C 7/34

[52] U.S. Cl. ..... 430/552; 430/553

[58] Field of Search ..... 430/552, 553

[56] References Cited

U.S. PATENT DOCUMENTS

| | | | |
|---|---|---|---|
| 4,288,532 | 9/1981 | Seoka et al. | 430/553 |
| 4,960,685 | 10/1990 | Bowne | 430/505 |
| 5,206,129 | 4/1993 | Sato et al. | 430/558 |
| 5,380,638 | 1/1995 | Takizawa et al. | 430/552 |

*Primary Examiner*—Lee C. Wright
*Attorney, Agent, or Firm*—Arthur E. Kluegel

[57] ABSTRACT

A photographic element comprises a light-sensitive silver halide emulsion layer having associated therewith a cyan dye forming coupler having the formula:

wherein:

X represents hydrogen or a coupling-off group bonded to the coupling position of the coupler and capable of being split off by an oxidized color developer; and R represents an aliphatic or aromatic substituent group. The element provides improved hue of the cyan dye formed from the coupler upon coupling.

11 Claims, No Drawings

PHOTOGRAPHIC MATERIALS AND PROCESS COMPRISING UREIDO NAPHTHOLIC CYAN COUPLERS

CROSS REFERENCE TO RELATED APPLICATION

Reference is made to and priority claimed from U.S. Provisional application Ser. No. U.S. Ser. No. 60/006,048, filed 24 Oct. 1995, entitled PHOTOGRAPHIC MATERIALS AND PROCESS COMPRISING UREIDO NAPHTHOLIC CYAN COUPLERS.

1. Field of the Invention

This invention relates to photographic elements containing a silver halide emulsion layer having associated therewith a naphtholic cyan dye-forming coupler. The naphtholic ring contains a 2-phenylethylcarbamoyl substituent where the phenyl ring contains a ureido group in the 2-position of the phenyl ring.

2. Background of the Invention

A typical photographic element contains multiple layers of light-sensitive photographic silver halide emulsions with one or more of these layers being spectrally sensitized to blue light, green light, or red light, respectively. The blue, green, and red light sensitive layers will typically contain yellow, magenta or cyan dye forming couplers, respectively.

For forming color photographic images, the color photographic material is exposed imagewise and processed in a color developer bath containing an aromatic primary amine color developing agent. Image dyes are formed by the coupling reaction of these couplers with the oxidized product of the color developing agent. Generally, image couplers are selected to provide image dyes with good stability towards heat and light and which desirably have a desirable absorption curve with a suitable peak absorption and low unwanted side absorptions in order to provide color photographic images with good color reproduction.

The couplers used to produce cyan image dyes are generally derived from phenols and naphthols, as described, for example, in U.S. Pat. Nos. 2,367,351, 2,423,730, 2,474,293, 2,772,161, 2,772,162, 2,895,826, 2,920,961, 3,002,836, 3,466,622, 3,476,563, 3,880,661, 3,996,253, 3,758,308, in French patents 1,478,188 and 1,479,043, and in British patent 2,070,000. These types of couplers can be used either by incorporating them in the red sensitive photographic silver halide emulsion layers or by including them in the processing baths. In the former case the couplers must have ballast substituents built into the molecule to prevent the couplers from migrating from one layer to another.

Although these couplers have been used extensively in photographic film and paper products, the dyes derived from them still suffer from peak absorption wavelengths (λ-max) that are too high and from undesirable side absorptions, causing considerable reduction in the quality of color reproduction.

Cyan couplers which have been so far proposed to overcome this problem are nitrogen containing heterocyclic couplers as disclosed in U.S. Pat. Nos. 4,728,598, 4,818,672, 4,873,183, 4,916,051, 5,118,812, 5,206,129, and EP patent 249,453A. Even though cyan dyes produced by these couplers show a reduction in their undesirable side absorptions, these couplers exhibit undesirably low coupling activity. Furthermore, the dyes derived from them have very low stability against heat and light, and have a very short absorption peak (λ-max). These disclosed couplers are therefore not practical for use in photographic products.

As another way of obtaining a cyan color dye having improved spectral absorption characteristics, the phenomenon of dye aggregation has been employed. This principal employs, for example, a photographic material that contains a cyan coupler of the N-aryl-1-hydroxy-2-naphthamide type as described by formulas I (U.S. Pat. No. 5,380,638), II, or III.

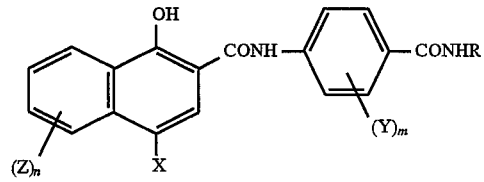

(I)

wherein

R represents a hydrogen atom, an alkyl group having 1 to 8 carbon atoms, or an aryl group having 6 to 20 carbon atoms, Y represents a group capable of substitution onto a benzene ring, Z represents a group capable of substitution onto a naphthalene ring, X represents a hydrogen atom or a coupling-off group, m is an integer of 0 to 4, and n is an integer of 0 to 4.

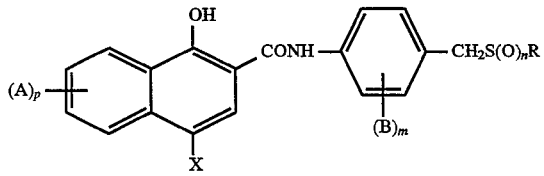

(II)

wherein

X represents a hydrogen atom or a coupling-off group;

m is an integer from 0 to 4, n is 1 or 2, and p is an integer from 0 to 4;

R and each A independently represent a substituent group; and

B is a substituent group selected from the group consisting of cyano, halogen, alkyl, alkoxy, aryloxy, acyloxy, acylamino, sulfonyloxy, sulfamoylamino, sulfonamido, ureido, alkoxycarbonyl or aryloxycarbonyl, alkoxycarbonylamino or aryloxycarbonylamino, and a carbamoyl group.

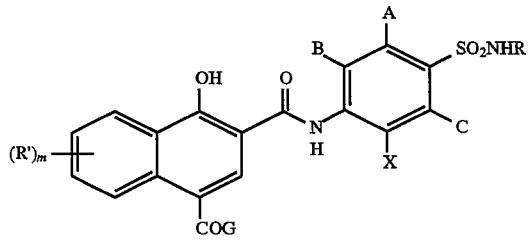

(III)

wherein

A, B, and C are hydrogen or fluorine;

X is selected from the group consisting of halogen, alkoxy and methyl groups;

R is a straight chain aliphatic group which is unsubstituted or substituted with one or more members selected from the group consisting of —F, —OR", —$SO_2$R", —$SO_2$NHR", —CONHR", —COOR", —NHCOR", —NH$SO_2$R", and —OCOR" where R" is a primary or secondary alkyl group;

R' is a substituent group and m is from) to 4;

COG is hydrogen or a coupling-off group capable of being split-off by an oxidized color developer.

All of these couplers are based on a common basic structure in which the phenyl ring, substituted at the 4-position with a carbamoyl group (in formula I), a methylene sulfone group (in formula II), or a sulfamoyl group (in formula III), is directly linked to the 1-naphthol ring through a common primary carbonamido function. Unfortunately, these structural features which are necessary for inducing the desired image dye aggregation or dye crystallization also lead to unacceptably high levels of yellow stain in the unexposed regions of the photographic element.

Other cyan couplers proposed for improving color reproduction are disclosed in U.S. Pat. Nos. 3,552,962, 3,839,044, and 4,960,685, and German patent publications DE3,055,355 and DE3,022,915. All of these couplers are based on a well-known coupler parent (formula IV), disclosed in U.S. Pat. No. 3,022,836, that is currently used in the cyan color developer of the Eastman Kodak Co. Kodachrome® process. However, to use these couplers as couplers incorporated in the photographic element rather than in the developer, and to achieve the same sharp-cutting dye hue as provided by the coupler represented by formula IV, these couplers must of necessity be substituted in the 4-position by a coupling-off group, usually an aryloxy group, that contains a ballast or is anchored to a suitable polymeric backbone, as illustrated by formula V. Any attempt to attach the ballast to the coupler parent molecule, for example, by replacing the acetamido substituent on the phenyl ring with an amido substituent containing two or more carbon atoms, has led to amorphous image dyes with undesirably broad spectral absorption.

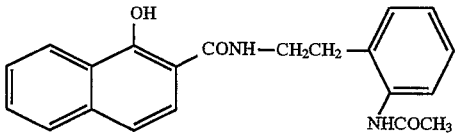

(IV)

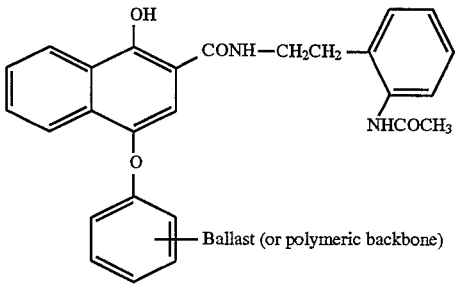

(V)

While the couplers of formula V form the same dye as that of formula IV, their color reproducibility is highly variable and highly dependent on the type and nature of the coupling-off group, which because of the presence of the ballast or the polymeric backbone is not readily washed out of the photographic element during processing. Further, the degree of aggregation and therefore the dye hue, is strongly dependent on the density of the dye image.

A problem to be solved, therefore, is to provide a photographic element containing a cyan dye forming coupler which exhibits excellent photographic properties such as hue and reduced side absorptions of the formed dye, particularly on the short wavelength side of the spectrum.

SUMMARY OF THE INVENTION

The present invention provides a photographic element which comprises a light-sensitive silver halide emulsion layer having associated therewith a cyan dye forming coupler having the formula:

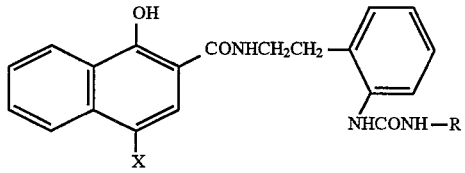

wherein:

X represents hydrogen or a coupling-off group bonded to the coupling position of the coupler and capable of being split off by an oxidized color developer; and R represents an aliphatic or aromatic substituent group. The element provides improved hue of the cyan dye formed from the coupler upon coupling.

These naphtholic couplers containing a ureido substituent readily form microcrystalline image dyes with oxidized p-phenylene diamine color developers. Unlike naphtholic couplers containing amido-substituents that form microcrystalline image dyes only if the amido-substituent is methyl and the coupler parent group is unballasted, the couplers of this invention are not limited by the nature or size of the ureido-substituents.

DETAILED DESCRIPTION OF THE INVENTION

In the formula for the coupler of the invention, X represents hydrogen or a coupling-off group capable of being split off by an oxidized color developer such as a group linked to the coupling position by an atom of chlorine, fluorine, oxygen, or sulfur. Suitable coupling-off groups are, for example, Cl, F, aryloxy, alkoxy, arylthio, or alkylthio groups. More suitably, X represents hydrogen, Cl, aryloxy or arylthio. If desired, X may contain a photographically useful group.

Suitable for R in the formula are aliphatic groups containing at least 4 aliphatic carbon atoms or aromatic groups. The aliphatic group referred to herein may be any aliphatic group such as, for example, a linear, branched, or cyclic hydrocarbon group, which may be substituted or unsubstituted, and may be saturated or unsaturated, such as methyl, ethyl, octyl, dodecyl, cyclohexyl, or α-(2,4-di-t-pentylphenoxy)butyl. The aromatic group referred to herein may be any aromatic group such as, for example, phenyl, naphthyl, p-cyanophenyl, pentafluorophenyl, p-octadecyloxphenyl, 3-hexadecylsulfonamidophenyl, or a heterocyclic ring which may be substituted or unsubstituted. Suitably, R contains up to 50 carbon atoms, preferably up to 30 carbon atoms. Typically, the R group is a long chain aliphatic group or a phenyl group.

To be incorporated in a photographic element, the coupler must contain sufficient hydrophobic components to prevent the coupler from diffusing to a different layer of the photographic element. If the coupler is found to diffuse, then a ballasting group must be added to render the coupler non-diffusible. The ballast group is one which, in conjunction with the other molecular features of the coupler, renders the coupler non diffusible in the photographic element. Such a ballast group will typically contain four or more aliphatic carbon atoms and more often 8 or more such atoms. The ballast may be a part of the substituent R or may be incorporated in the coupling-off group of the coupler. The ballasting may also be accomplished through the use of a polymeric backbone to bond together two or more couplers at the coupling site in order to achieve the desired ballasting effect.

The photographic element of the invention is suitably an element designed for viewing such as a print or transparency, but a color negative image capture element may also employ the invention.
The following coupler examples further illustrate the invention. It is not to be construed that the present invention is limited to these examples.
M-1
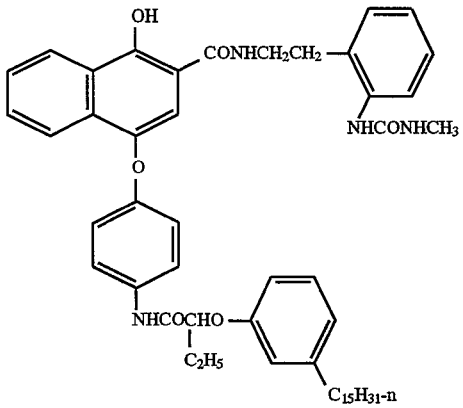
M-2
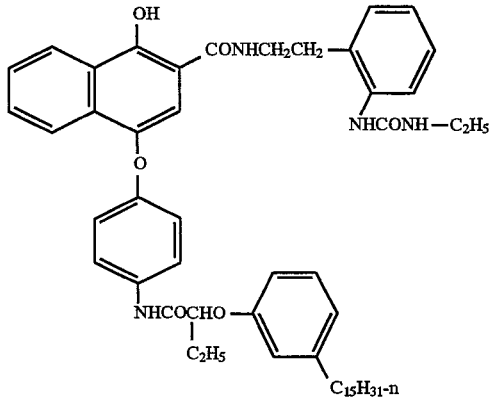
M-3
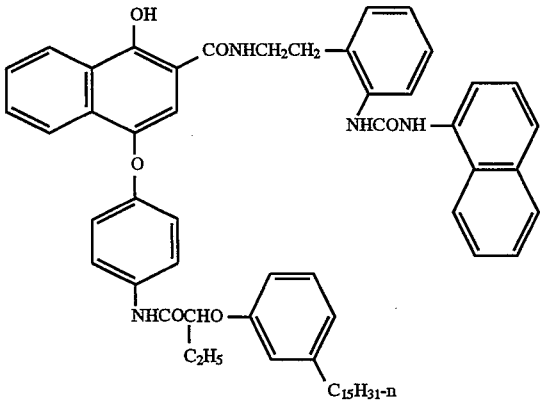
M-4
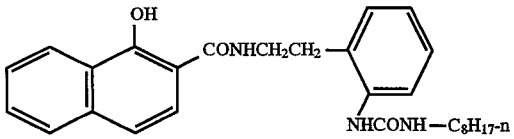
M-5
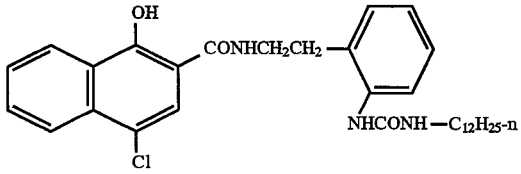

-continued
M-6
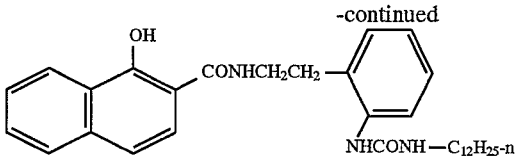
M-7
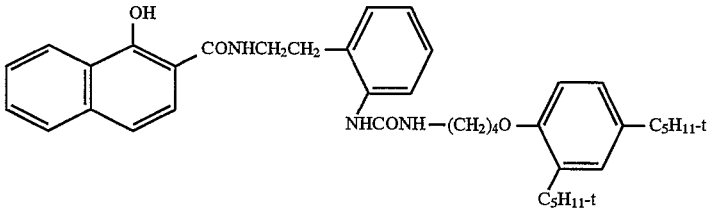
M-8
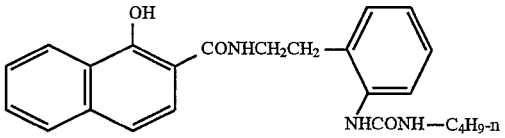
M-9
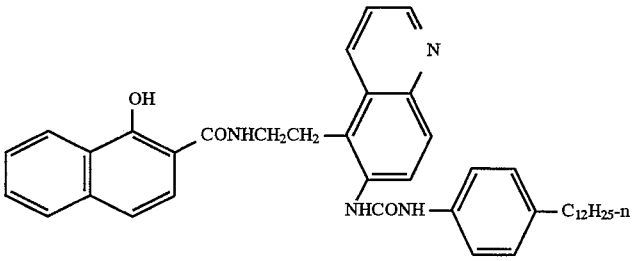
M-10
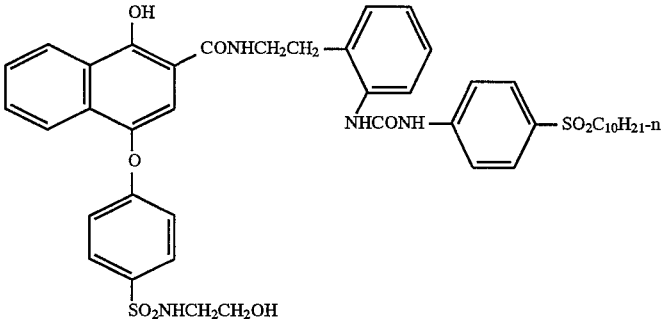
M-11
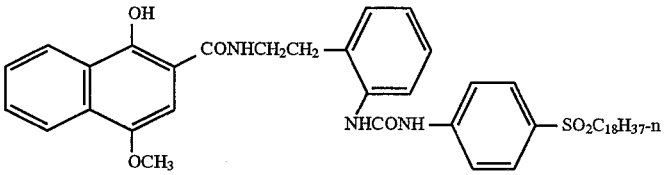
M-12
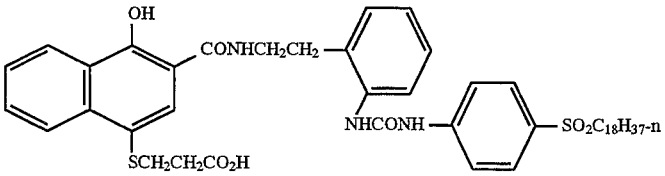
M-13
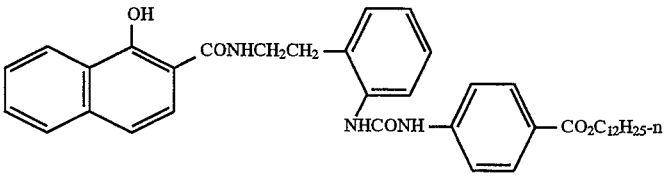

-continued
M-14
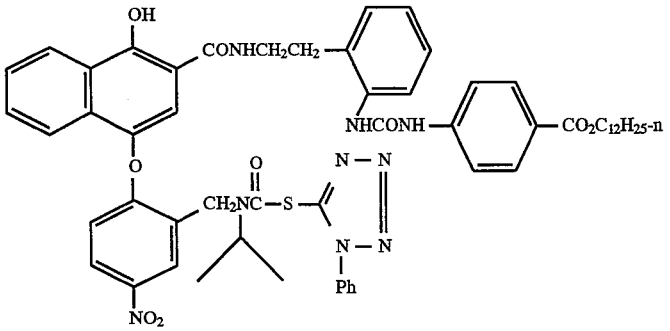
M-15
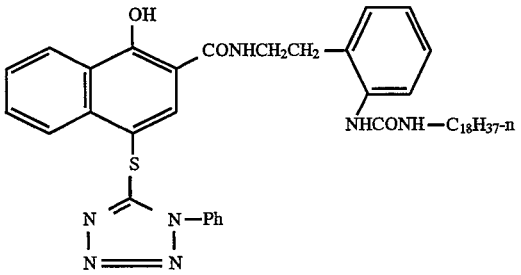
M-16
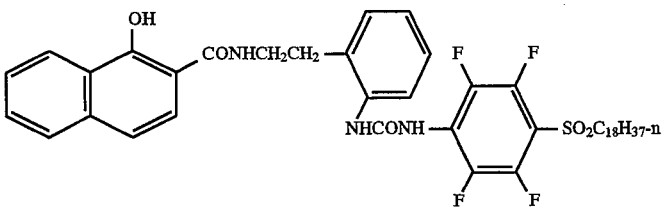
M-17
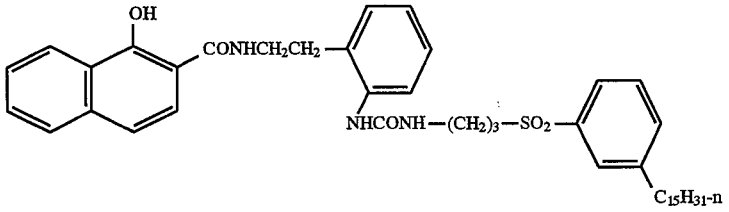
M-18
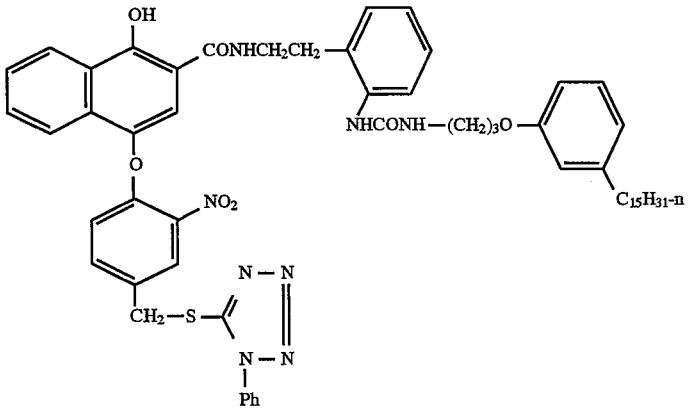

-continued

M-19

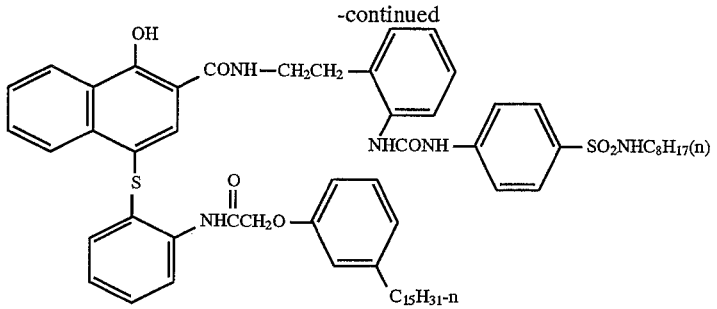

M-20

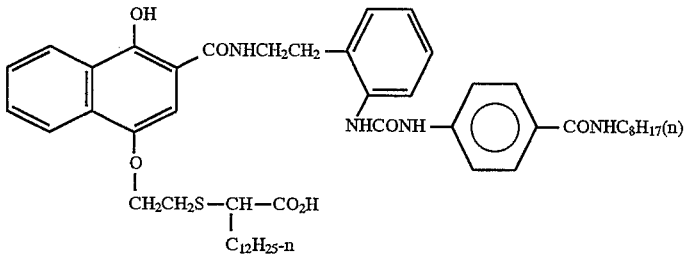

Unless otherwise specifically stated, substituent groups which may be substituted in X or R substituents herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecylphenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

Representative ballast groups include substituted or unsubstituted alkyl or aryl groups containing up to 50 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1994, Item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems, and processing methods and agents are described in Sections XV to XX. Certain desirable photographic elements and processing steps, particularly those useful in conjunction with color reflective prints, are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: UK. patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. Nos. 4,301,235; 4,853,319 and 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. Nos. 4,163,669; 4,865,956; and 4,923,784, may be useful. Also contemplated is use of the compositions in association with nucleating agents, development accelerators or their precursors (UK Patent 2,097,140; UK. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556; and 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIRs). DIRs useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

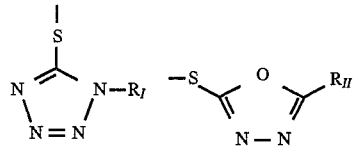

-continued

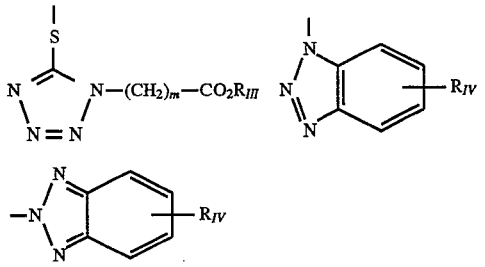

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group, which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845; Japanese Applications 57-188035; 58-98728; 58-209736; 58-209738) groups utilizing ester hydrolysis (German Patent Application (OLS) No. 2,626,315); groups utilizing the cleavage of imino ketals (U.S. Pat. No. 4,546,073); groups that function as a coupler or reducing agent after the coupler reaction (U.S. Pat. Nos. 4,438,193; 4,618,571) and groups that combine the features describe above. It is typical that the timing group or moiety is of one of the formulas:

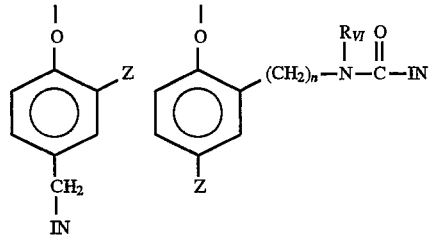

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

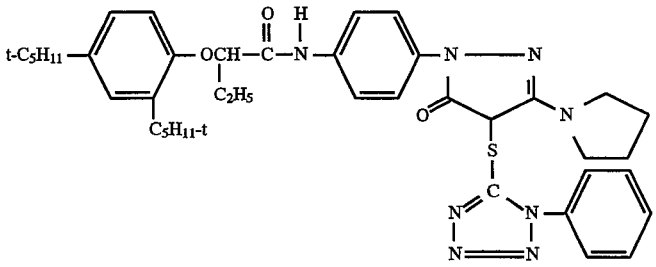

D2

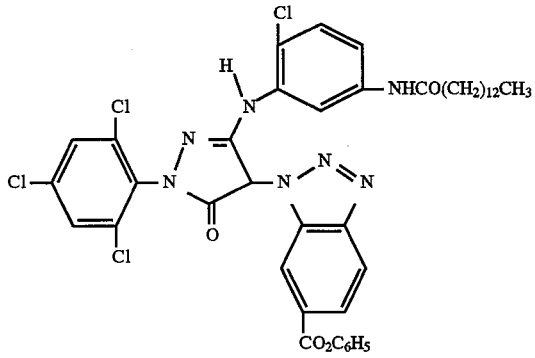

-continued
D3
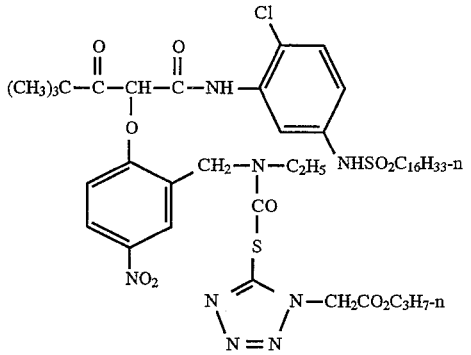
D4
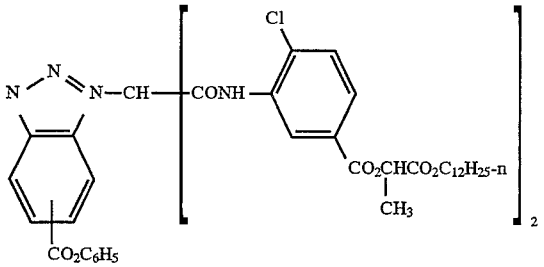
D5
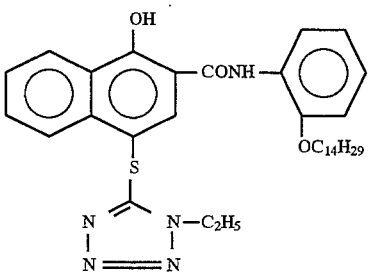
D6
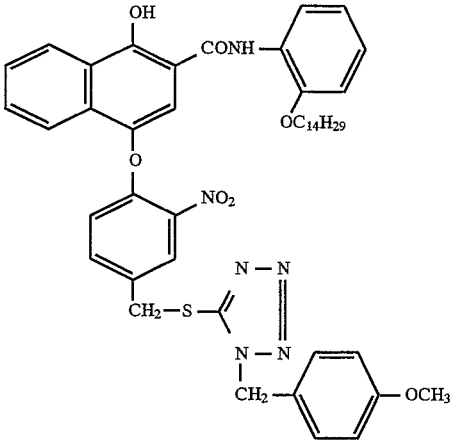

-continued
D7
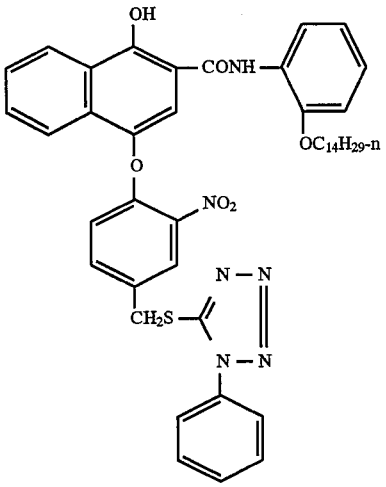
D8
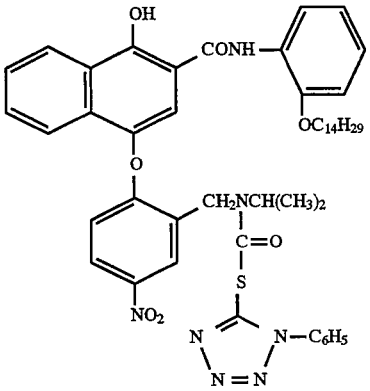
D9
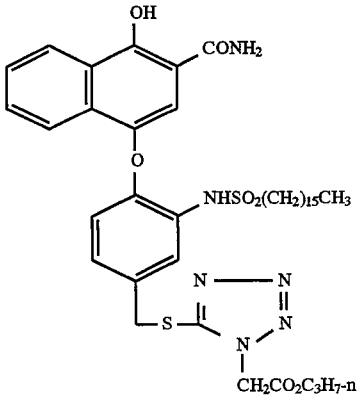

-continued

D10

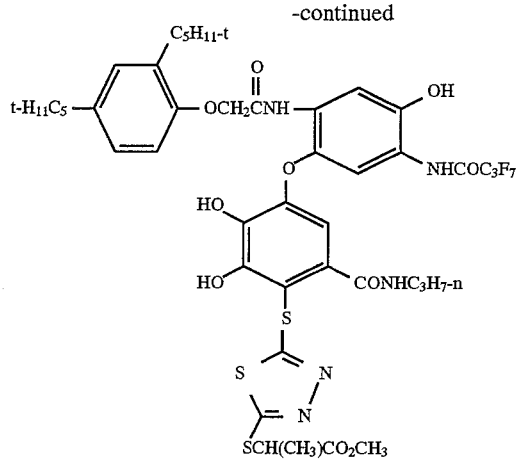

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. Nos. 4,346,165; 4,540,653 and 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.06 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: *Research Disclosure*, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known Kodak C-41 color process as described in The British Journal of Photography Annual of 1988, pages 191–198. Where applicable, the element may be processed in accordance with color print processes such as the RA-4 process of Eastman Kodak Company as described in the British Journal of Photography Annual of 1988, Pp 198–199. Such negative working emulsions are typically sold with instructions to process using a color negative method such as the mentioned C-41 or RA-4 process. To provide a positive (or reversal) image, the color development step can be preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as E-6. Alternatively, a direct positive emulsion can be employed to obtain a positive image.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl) aniline sesquisulfate hydrate, 4-amino-3-methyl-N-ethyl-N-(2-hydroryethyl)aniline sulfate, 4-amino-3-(2-methanesulfonamido-ethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the various copending applications as well as patents and other publications cited in this specification are incorporated herein by reference.

SYNTHESIS EXAMPLES

Cyan couplers of the present invention can be prepared using known methods and known starting materials. Typical methods of preparing couples M-3 and M-6 are described below:

Preparation of Coupler M-3

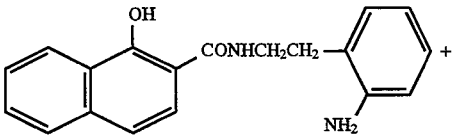

(1)

-continued

Preparation of Coupler M-3

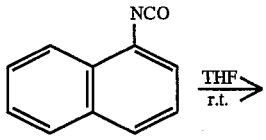

(2)

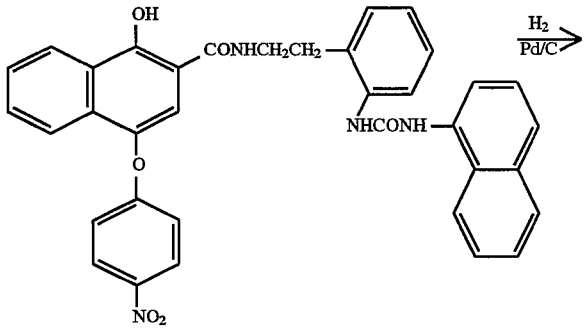

(3)

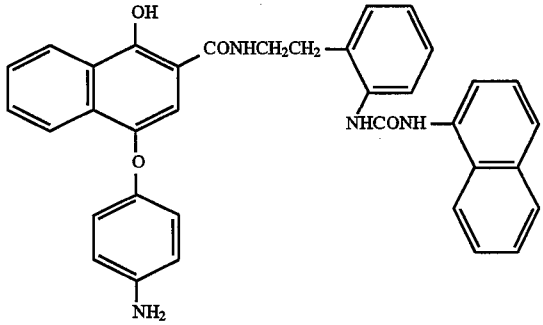

(4)

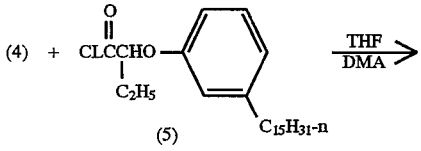

(5)

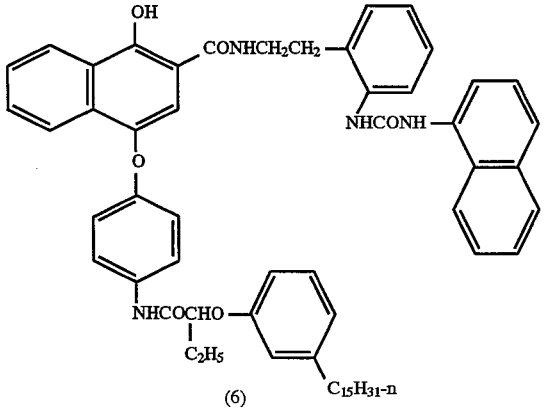

(6)

To a solution of 6.7 (0.015 mol) of (1) in 1.50 mL of dioxane and 50 mL of dimethylformamide was added with stirring 2.7 g (0.016 mol) of naphthyl isocyanate (2). After stirring for 5 hr. at room temperature, the mixture was diluted with 200 mL of methanol. The yellow solid which precipitated out was collected and recrystallized from DMF-MeOH to give 8.7 g (95%) of yellow solid; m.p. 231°–232°

C. The structure of the compound (3) was consistent with its H'NMR spectrum.

Calcd. for $C_{36}H_{25}N_4O_6$: C, 70.58; H, 4.61; N, 9.15 Found: C, 70.28; H, 4.93; N, 9.33

A solution of 6.1 g (0.01 mol) of (3) prepared as described above and a spoonful of 10% Pd/C in 200 ml. dioxane was reduced at r.t. under 50 pounds of $H_2$ for 5 hr. The mixture was filtered through a pad of celite to remove the catalyst. To the filtrate was added with stirring 2.4 g (0.02 mol) of N,N-dimethylaniline (DMA) and 4.1 g (9.01 mol) of m-pentadecylphenoxybutryl chloride (5). After stirring at r.t. for 2 hr. the mixture was poured into ice water containing 5 mL. HCl. The solid which precipitated out, was collected, washed with water and recrystallized from THF-MeOH to yield 8.5 g (89%) of white crystalline solid; m.p. 156°–158° C. The structure of product (6) corresponding to coupler M-3 of the present invention is consistent with its H-NMR spectrum.

Calcd for $C_{61}H_{70}N_4O_6$: C, 76.70; H, 7.39; N, 5.87 Found: C, 76.65; H, 7.44; N, 5.76

Preparation of Coupler M-6

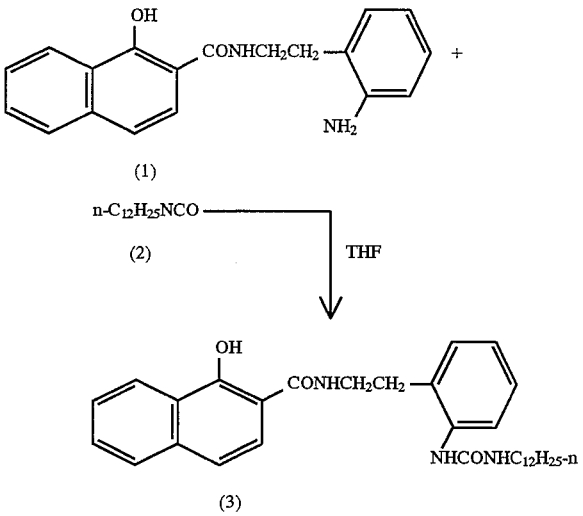

To a stirred solution of 15.3 g (9.05 mol) of (1) in 150 mL THF was added 10.8 g (0.051 mol) of dedecylisocyanate (2). The mixture was heated on a steam bath and refluxed for 2 hr. After cooling to r.t. the mixture was poured into ice water. The solid which precipitated out was collected and recrystallized from EtOH to give 18.9 g (73%) of crystalline white product; m.p. 131°–133° C. The structure of (3) corresponding to coupler M-6 of the present invention is consistent with its H'NMR spectrum.

Calcd. for $C_{32}H_{43}N_3O_3$: C, 74.24; H, 8.37; N, 8.12 Found: C, 74.16; H, 8.68; N, 8.07

PHOTOGRAPHIC EXAMPLES

On a cellulose acetate-butyrate support were coated the following layers:

First Layer

An emulsion layer comprising (per square meter) 3.77 grams gelatin, an amount of silver bromoiodide emulsion (expressed as silver) equal to 0.45 g for couplers having a coupling-off group and 0.90 g for couplers having hydrogen at the coupling position, and an amount of dibutyl phthalate equal to the weight of coupler multiplied by the "Solvent Ratio" shown in the Table.

Second Layer

A protective layer containing 2.69 grams gelatin and 0.12 gram bis(vinylsulfonyl)methane per square meter.

Processed film samples 1–14 were prepared by exposing the above-described coatings through a step wedge and processing as follows:

| Process Step | Time (min.) | Temp. (C.) |
|---|---|---|
| Developer | 2.75 | 37.8 |
| Stop Bath | 0.30 | 37.8 |
| Bleach | 4.00 | 37.8 |
| Water wash | 3.00 | 37.8 |
| Fixer | 4.00 | 37.8 |
| Water wash | 3.00 | 37.8 |

The processing solutions used in the above process had the following compositions (amounts per liter of solution):

| | |
|---|---|
| Developer | |
| Potassium carbonate | 37.50 g |
| Sodium sulfite | 4.00 g |
| Potassium iodide | 1.20 mg |
| Sodium bromide | 1.30 g |
| 1,3-Diamino-2-propanoltetraacetic acid | 2.50 g |
| Hydroxylamine sulfate | 2.00 g |
| 4-Amino-3-methyl-N-ethyl-N-beta-hydroxy-ethylaniline sulfate | 4.50 g |
| pH adjusted to 10.00 at 26.7° C. | |
| Stop Bath | |
| Sulfuric acid | 10.00 g |
| Bleach | |
| Ammonium bromide | 150.00 g |
| Ammonium ferric ethylenediaminetetraacetate | 77.00 g |
| Ethylenediaminetetraacetic acid | 6.13 g |
| Acetic acid | 9.50 mL |
| Sodium nitrate | 35.00 g |
| pH adjusted to 6.00 at 26.7° C. | |
| Fixer | |
| Ammonium thiosulfate | 91.53 g |
| Ammonium sulfite | 6.48 g |
| Sodium metabisulfite | 1.00 g |
| pH adjusted to 6.50 at 26.7° C. | |

The spectra of the resulting dyes were measured and normalized to a maximum absorption of 1.00. The slope of the left side of each normalized spectrum, measured between densities of 0.50 and 0.75, was determined. For this purpose, the slope was determined by dividing 0.25 by the difference obtained by subtracting the wavelength producing a density of 0.5 from the wavelength producing a density of 0.75. Due to the small values resulting, the slope was then multiplied by 100 to yield a more useful value corresponding to the slope. The slope×100 values are shown in Table 1.

TABLE 1

| Example | Coupler | Solvent Ratio | Slope × 100 |
|---|---|---|---|
| 1 | CC-6 | 0.5 | 0.86 |
| 2 | C-3 | 0.5 | 0.96 |
| 3 | M-1 | 0.5 | 1.56 |
| 4 | M-3 | 0.5 | 1.25 |
| 5 | M-4 | 0.5 | 1.56 |
| 6 | M-6 | 0.5 | 2.50 |
| 7 | M-7 | 0.5 | 2.50 |
| 8 | C-1 | 1.0 | 1.56 |

TABLE 1-continued

| Example | Coupler | Solvent Ratio | Slope × 100 |
|---|---|---|---|
| 9 | C-2 | 1.0 | 0.93 |
| 10 | C-4 | 1.0 | 0.93 |
| 11 | C-5 | 1.0 | 1.09 |
| 12 | M-1 | 1.0 | 1.56 |
| 13 | M-6 | 1.0 | 2.50 |
| 14 | M-8 | 1.0 | 2.27 |

In the Table, different solvent ratios were used in different test sets but, as indicated by the two values for M-1 and M-6, the particular solvent ratio employed does not affect the resulting absorption curve shape.

It will be noted that the comparison couplers C-1 through C-5 are structurally similar to the couplers of our invention except that the ureido substituent on the phenyl ring is replaced by an amido substituent. Coupler C-1 is more specifically represented by formula V, discussed above under prior art. Check coupler CC-6 is not of this type, but is a cyan image coupler widely used in the photographic industry. In particular, C-1 and M-1; C-3 and M-3; and C-5 and M-6 are identical in structure except for the presence of a ureido vs amido group.

Comparison Couplers

C-1

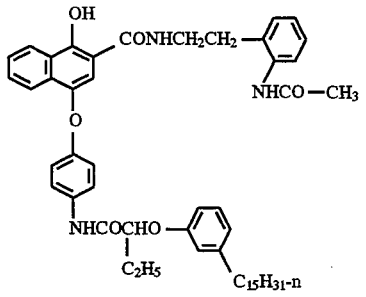

C-2

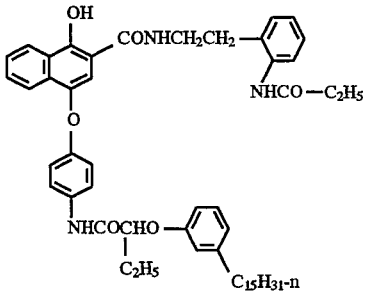

C-3

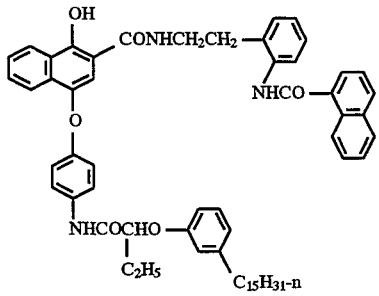

-continued

Comparison Couplers

C-4

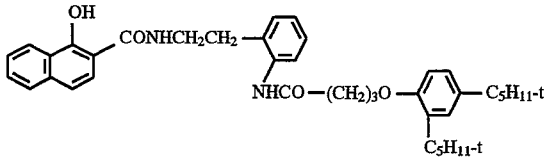

C-5

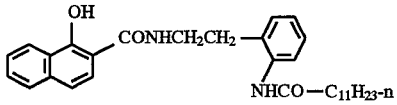

CC-6

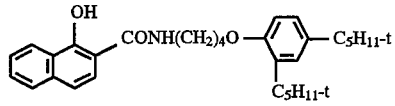

The data in Table 1 clearly show that regardless of the size and nature of the ureido substituents, all of the ureido couplers of the invention form sharp-cutting image dyes whose spectra have significantly steeper slopes on the short wavelength side of the absorption curves. On the other hand, of the comparison couplers containing amido substituents, only the dye from C-1, which contains an acetamido group, shows a steep slope (1.56) but this coupler is not useful for inclusion in a photographic element for reasons stated below. All of the comparison couplers with amido substituents containing two or more carbon atoms attached to the acyl carbon formed image dyes with broadly-absorbing dye curves. Compare C-3 (0.96) to M-3 (1.25), and C-5 (1.09) to M-6 (2.50). These data indicate that of the amido-substituted comparison couplers disclosed in the prior art, only one parent molecule, that represented by formula IV, is useful for forming sharp-cutting aggregated cyan dyes. However, such coupler cannot be successfully incorporated in a photographic element due to a lack of ballasting. Such coupler, by necessity, must be substituted at the coupling-position with a coupling-off group that contains a ballast as in the case of C-1. While C-1 forms aggregated dye, the degree of aggregation is strongly dependent on the image dye density, resulting in a variable image dye hue. The couplers of the invention do not have this problem. Furthermore, all attempts to shift the ballast from the coupling-off group to the amido group of the phenyl ring have proven futile because the added ballast destroys the dye aggregation phenomenon and thus the desired absorption curve shape is not obtained. On the other hand, the ureido-substituted couplers of the present invention do not suffer from this limitation. The present invention allows variation in the size and nature of the ureido substituents without adversely affecting their ability to form sharp-cutting aggregated or crystalline cyan dyes.

What is claimed is:

1. A photographic element which comprises a light-sensitive silver halide emulsion layer having associated therewith a cyan dye forming coupler having the formula:

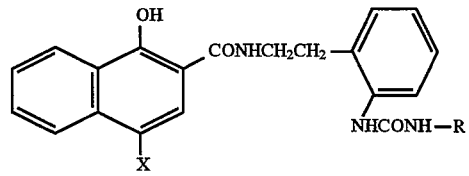

wherein:

X represents hydrogen or a coupling-off group bonded to the coupling position of the coupler and capable of being split off by an oxidized color developer; and R represents an aliphatic or aromatic substituent group wherein R contains at least 4 aliphatic carbon atoms.

2. The element of claim 1 wherein R and X are selected so as to contain sufficient hydrophobic groups to render the coupler nondiffusible within the photographic element.

3. The element of claim 1 wherein R is an aliphatic group which contains at least 4 carbon atoms.

4. The element of claim 1 wherein X contains a group sufficient to ballast the coupler within the photographic element.

5. The element of claim 1 wherein X is a coupling-off group linked to the coupling position by an atom of chlorine, fluorine, oxygen, or sulfur.

6. The element of claim 5 wherein X contains a photographically useful group.

7. The element of claim 1 wherein R is an aliphatic group containing up to 50 carbon atoms.

8. The element of claim 7 wherein R contains up to 30 carbon atoms.

9. The element of claim 1 wherein R is an aromatic group containing up to 50 carbon atoms.

10. The element of claim 1 wherein R is an aromatic group.

11. The element of claim 1 wherein R is an aromatic heterocyclic group.

* * * * *